United States Patent [19]

Hoerbelt

[11] Patent Number: 4,991,856

[45] Date of Patent: Feb. 12, 1991

[54] CIRCULAR CHESS GAME BOARD

[76] Inventor: Curtis Hoerbelt, 90 Townline Rd., Lancaster, N.Y. 14086

[21] Appl. No.: 378,592

[22] Filed: Jul. 11, 1989

[51] Int. Cl.[5] ..... A63F 3/02

[52] U.S. Cl. ..... 273/261; D21/24; D21/32; D21/35

[58] Field of Search ..... 273/261, 236, 242, 243, 273/287; D21/24, 32, 35

[56] References Cited

U.S. PATENT DOCUMENTS

D. 262,897 2/1982 Goldeen ..... D21/24

3,917,273 11/1975 Blakewood ..... 273/261

*Primary Examiner*—Benjamin Layno

*Attorney, Agent, or Firm*—Hodgson Russ Andrews Woods & Goodyear

[57] ABSTRACT

Circular game boards for play of a game of a variety of chess by two or more players, each of the boards having a plurality of playing spaces arranged in circular ranks and radial files, a plurality of non-playing spaces disposed between adjacent playing spaces on a diagonal, and a neutral central non-playing area, the neutral central area being provided with a center graphic which facilitates movement of the pieces across the central area.

5 Claims, 20 Drawing Sheets

CIRCULAR CHESS GAME BOARD

COPYRIGHT NOTICE

A portion of the disclosure of this patent document contains material which is subject to copyright protection. The copyright owner has no objection to facsimile reproduction by anyone of the patent document or the patent disclosure, as it appears in the Patent and Trademark Office patent file or records, but otherwise reserves all copyright rights whatsoever.

1. Technical Field

The present invention relates generally to a board game, and more particularly to a circular game board for play of a game of a variety of chess by two or more players.

2. Background

The game of chess, in its present form, has been known for many centuries. While the game is challenging for those of equal or near equal ability, it should be noted that well known moves have well known countermoves. In order to add excitement to the game many variations of the basic game, wherein each player plays 16 pieces on an eight-by-eight grid, have been developed. One such variation is three-dimensional chess, but this variation has only seemed to find acceptance in science fiction movies. Variations utilizing circular chess boards have received much attention, and typical examples are found in U.S. Pat. Nos. 3,776,554, 3,851,883, 3,917,273, 4,322,085, 4,553,756 and 4,804,191. The prior art game boards typically have the disadvantage in that it is difficult to envision diagonal movement such as that of a bishop. Another disadvantage of the prior art game boards is that in adapting the game of chess to a circular board it has typically been necessary to modify the game slightly in order to prevent the obvious consequences of playing on a circular board such as the initial rook captures rook move which would be possible on a circular game board. To overcome these inherent disadvantages of playing chess on a circular board various proposals have been made but none have gained widespread acceptance.

OBJECTS AND SUMMARY OF THE INVENTION

It is a principal object of the present invention to provide a circular game board which may be utilized for the play of a game of a variety of chess. In one of the illustrated embodiments the game board is designed for two players while in another illustrated embodiment the game board is designed for three players. However, it should be appreciated that by utilizing the principles of this invention a game board can be constructed for four or five players.

More particularly it is an object of the present invention to provide a circular game board having playing spaces arranged in circular ranks and radial files, adjacent diagonal playing spaces being separated from each other by non-playing spaces so that the players may better visualize diagonal movements.

It is a further object of the present invention to provide a circular game board of the type set forth above wherein a center graphic is provided, the center graphic facilitating movement of the pieces across a center neutral or non-playing area.

It is a further object of the present invention to provide a chess game suitable for play on the game board Of the type set forth above, which game has been modified to present a game more suitable for a circular chess board.

It is a further object of the present invention to provide a game board of the type set forth above wherein the same principles may be utilized for two, three, or more players.

The foregoing and other objects of this invention will become apparent from a consideration of the following detailed description taken in conjunction with the accompanying drawings in which preferred forms of this invention are illustrated, along with figures representing various modes of play.

DETAILED DESCRIPTION

Figure 1:
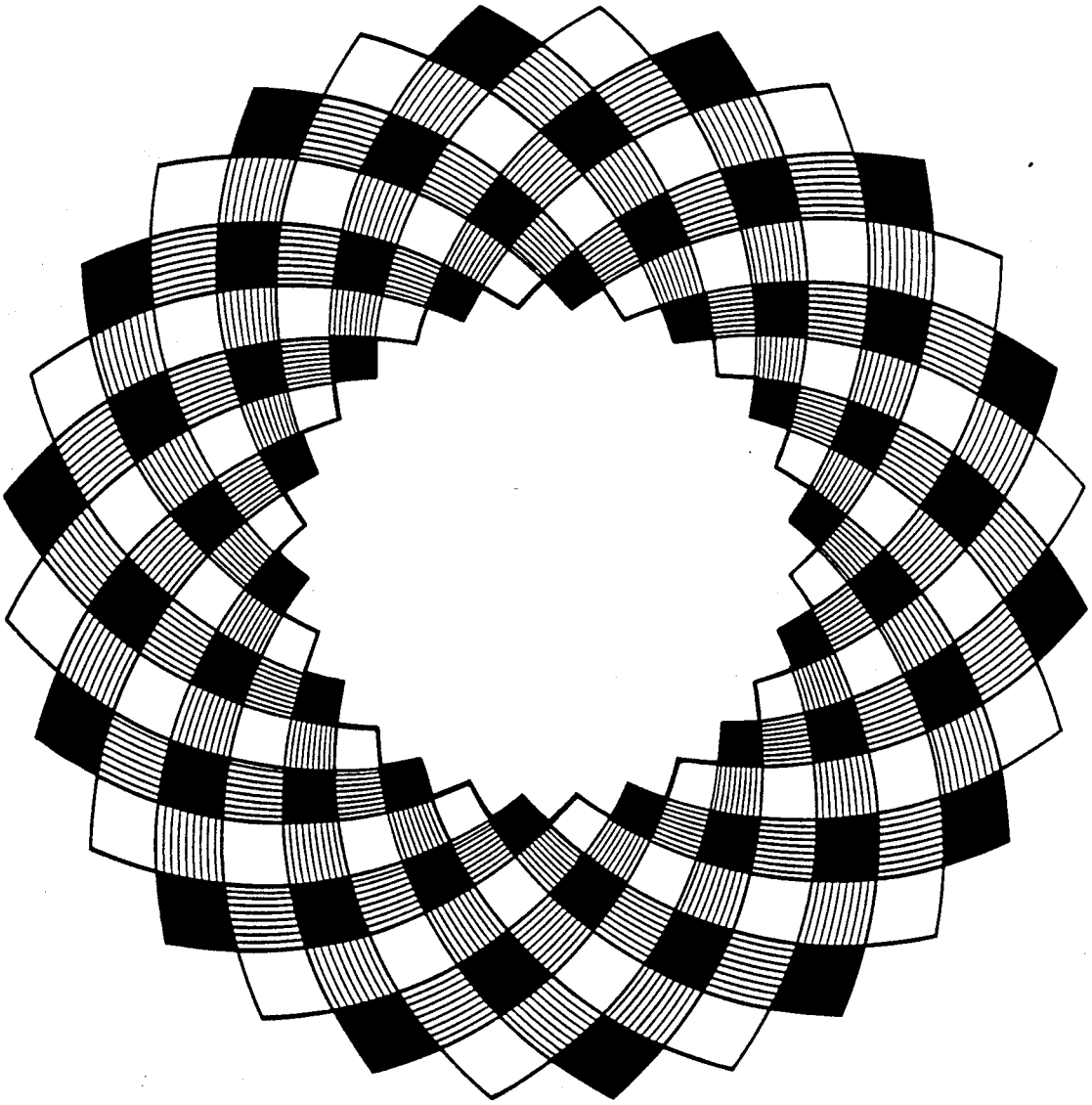
FIG. 1 is an illustration of the circular game board of this invention in a two-player configuration without center graphic.
Figure 1A:
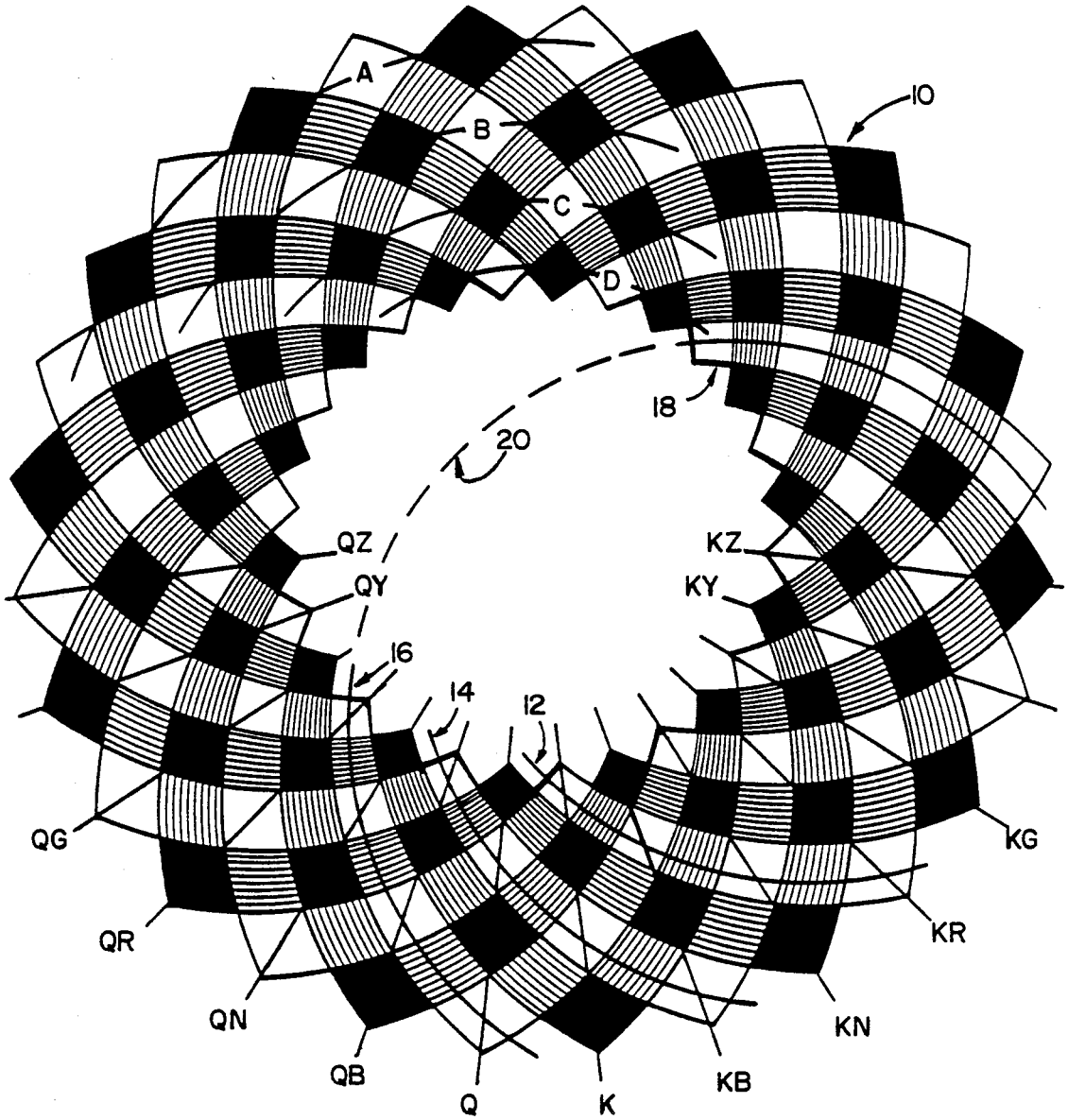
FIG 1*a* is the same as FIG. 1, except that reference indicia has been added.
Figure 16:
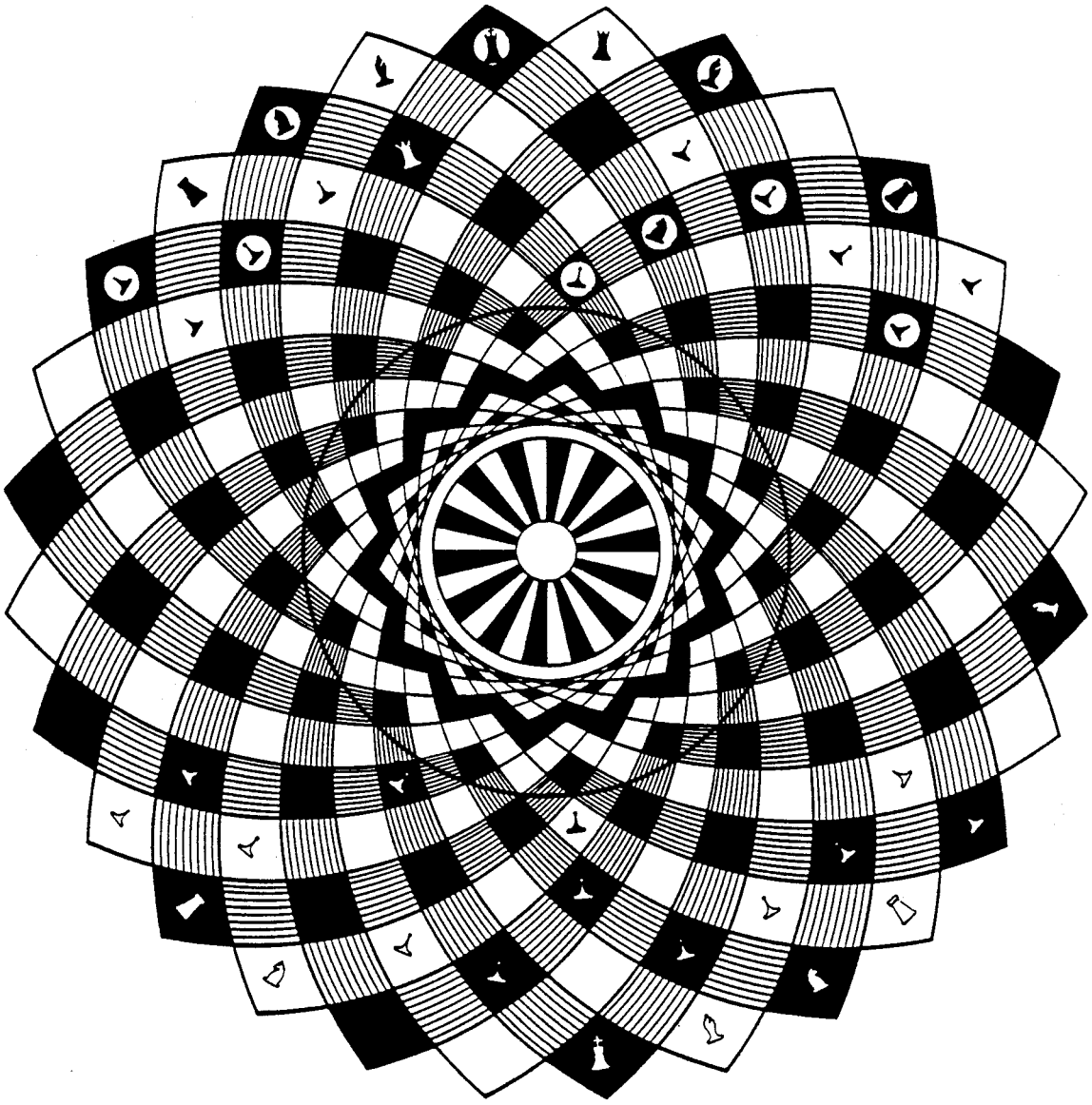
Figure 17:
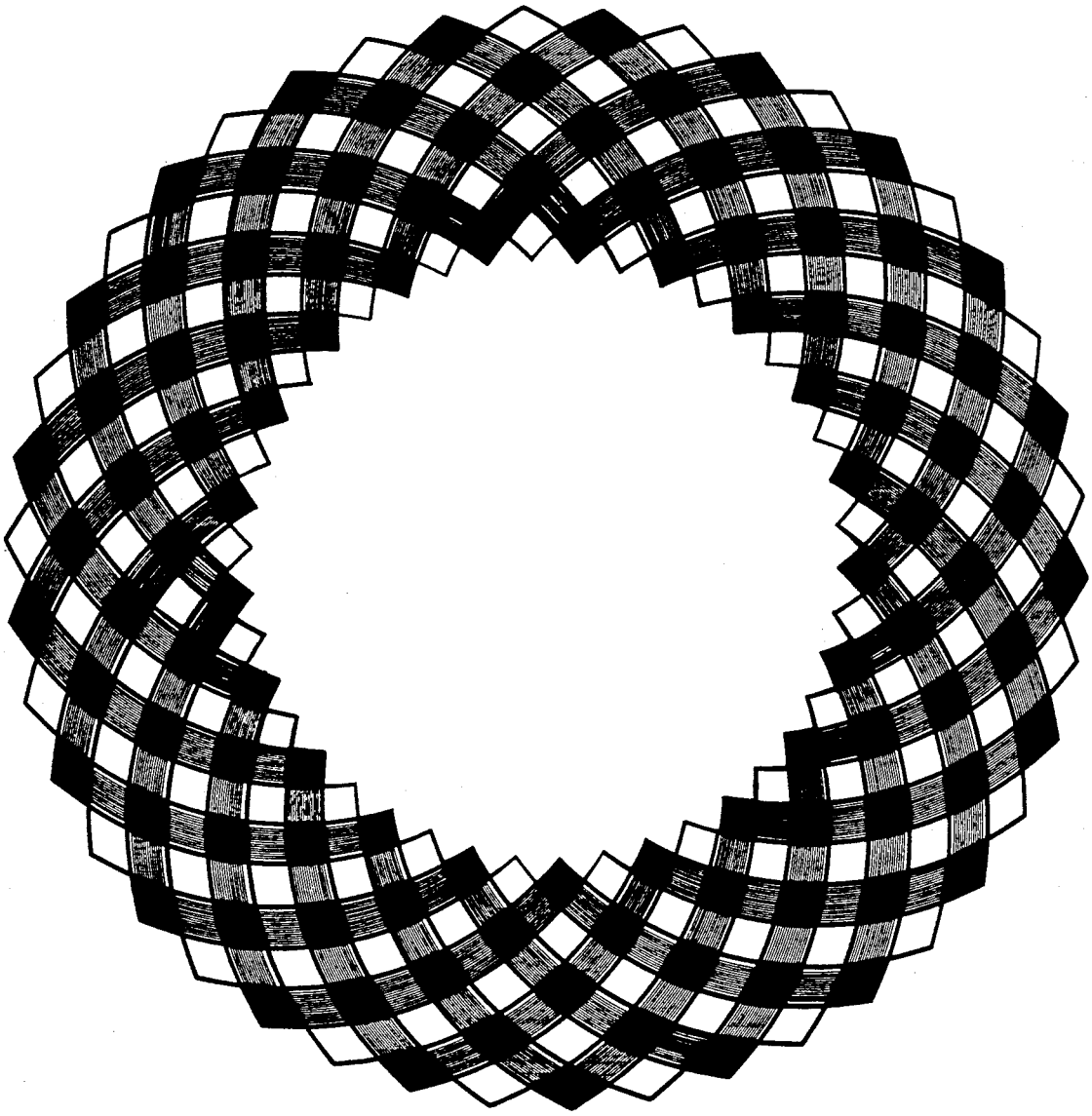
FIG. 17 illustrates the circular game board of this invention when designed for three players, this view excluding a center graphic.
Figure 18:
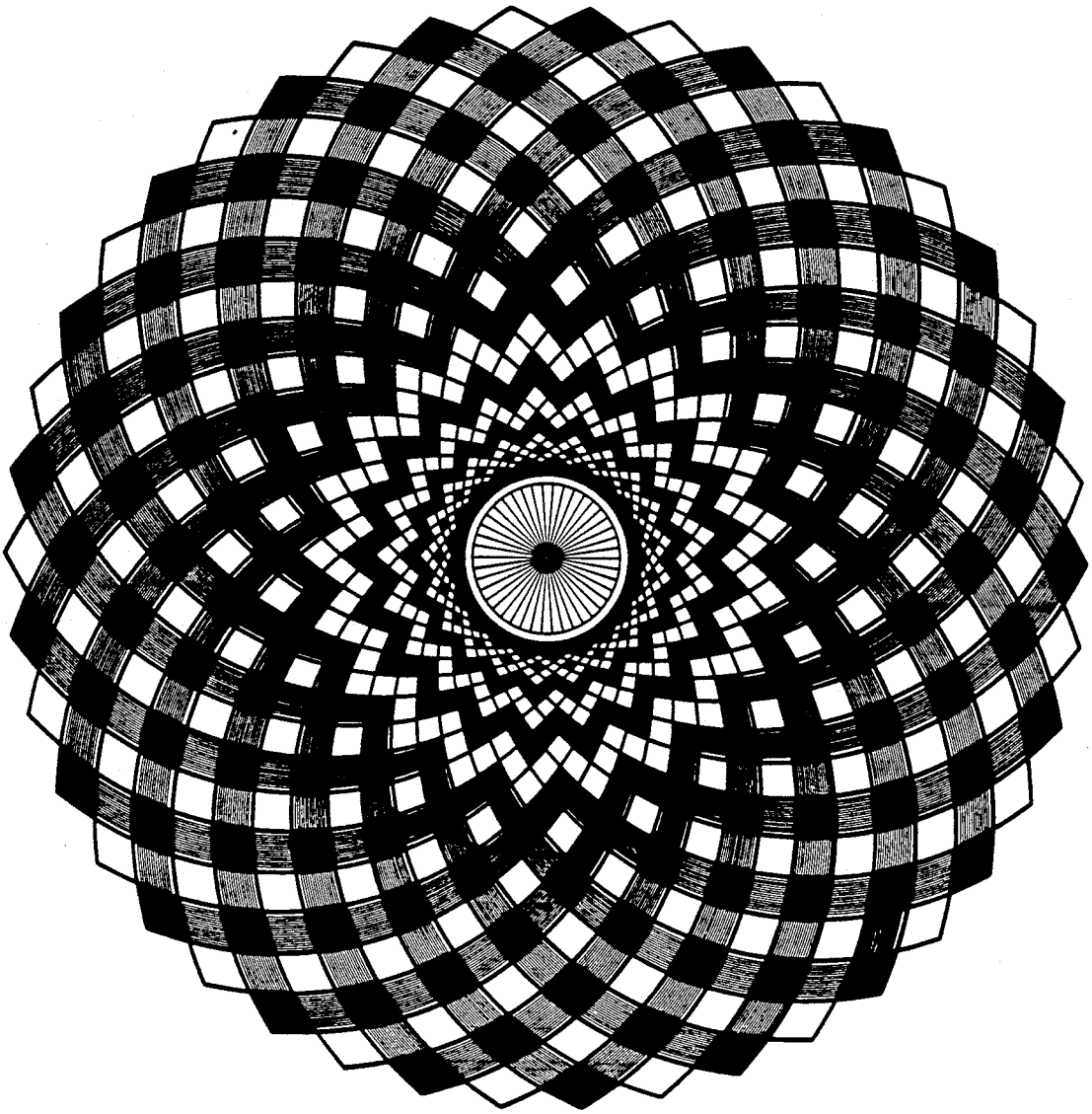
FIG. 18 is a view similar to FIG. 17, but with the center graphic.

As indicated above in the description of the figures two embodiments of this invention are illustrated, one being the two-player embodiment of FIGS. 1 through 16 and the second being the three-player embodiment shown in FIGS. 17 and 18. With reference initially to the two-player embodiment it can be seen that a circular game board is provided, which board is indicated generally at 10 in FIG. 1*a*. The board is composed of four concentric rings of 28 alternating black and white playing spaces indicated in the drawing as either solid white or solid black areas. Non-playing or neutral spaces, which are indicated by the lined areas are interspersed between the playing areas in the manner shown The non-playing spaces help a player visualize diagonal movement along arcs. In FIG. 1*a* three arcs are indicated by lines 12, 14 and 16 on one side of the board, a continuation of the playing arc 16 on the other side of the board being indicated by line 18, and the joining arc being shown by dotted line 20. The space occupied by dotted line 20 is normally occupied by a center graphic, shown in FIGS. 2 through 16, the purpose of the center graphic being to help a player visualize movement across the central non-playing or neutral zone. It can be seen from an inspection of FIG. 1*a* that the playing spaces are arranged in circular ranks and radial files. The ranks are indicated by the letters A, B, C, and D, with A indicating the outermost ring. The radial files are indicated by the piece which would normally occupy the outermost playing space this being shown only on one side of the board. Thus, the central files are indicated by the pieces which would be on the playing spaces in the A rank, these being (from left to right) queen's rook QR, queen's knight QN, queen's bishop QB, queen Q, king K, king's bishop KB, king's knight KN, and king's rook KR. The game played upon the board illustrated also envisions four additional pieces best shown in FIG. 12, these being queen's guard pawns in file QG occupying ranks A and 8 and king's guard pawns in file KG occupying ranks A and B. In order to provide proper spacing between one player's initial set-up and another player's initial set-up there are four radial files which do not receive any playing pieces during the initial set-up, these open files being indicated QZ QY KY and KZ.

Figure 17A:
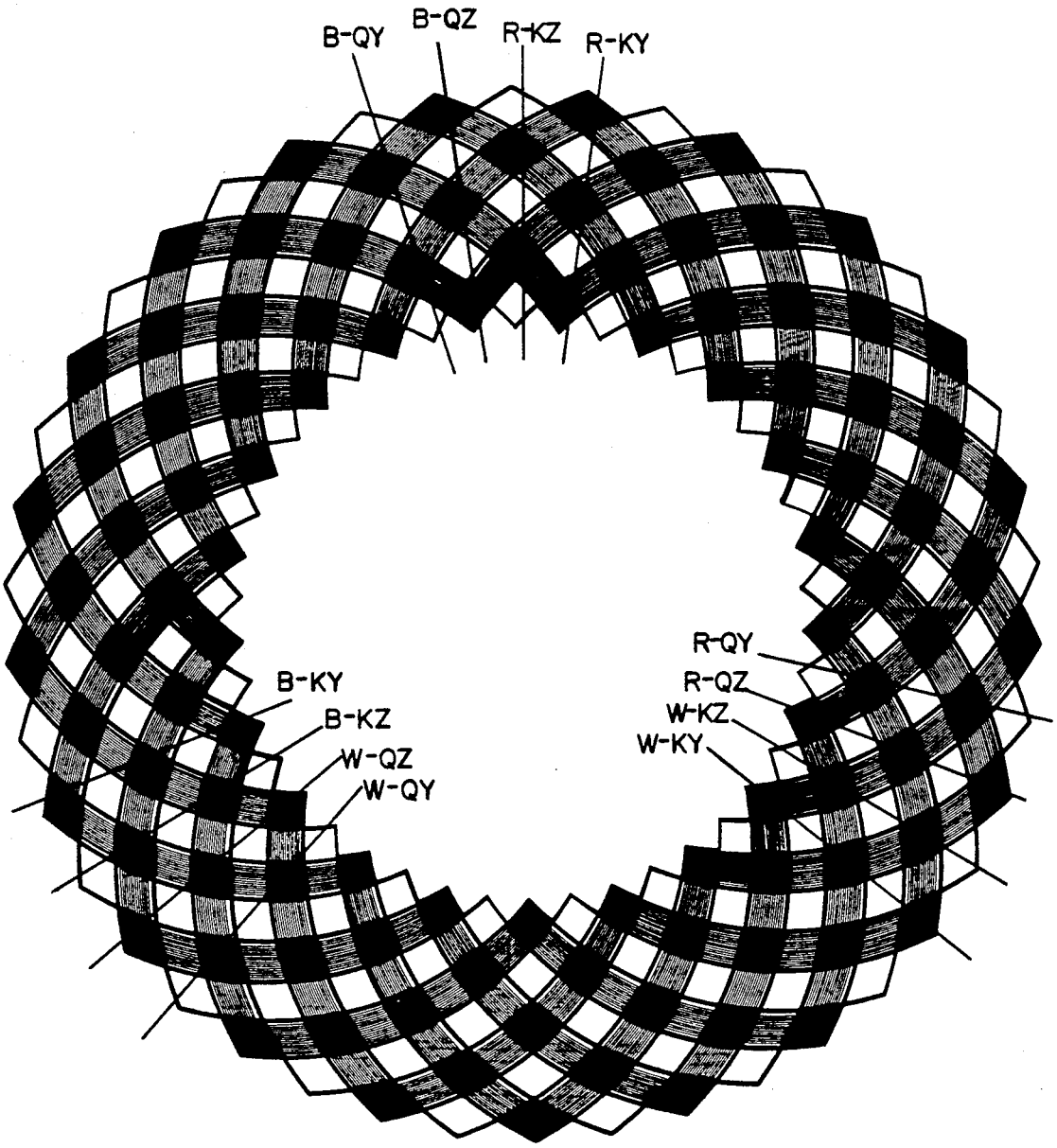
FIG. 17*a* is the same as FIG. 17 except that reference indicia has been added.

With reference now to FIG. 17 it can be seen that when the circular board is designed for three players that there are five ranks of 42 files. In this game obviously the playing pieces of the three different players will be of differing colors, for example, red, black, and white. Each player will initially have his own sector of the playing field of 14 spaces, the same as in the two-player game, with the open files being indicated by CZ, QY, KY, and KZ which files may be preceeded by a letter indicating the color, for example B, R, and W for black, red and white, respectively. In FIG. 17*a* only the open files are indicated.

The manner in which the round game of chess illustrated in the accompanying figures may be played is further described in detail in the following copyright material, to which page numbers have been added.

THE GAME OF VORTEX

It all began with the idea of making a better three-player chess game. Existing boards lacked a uniform playing surface. The board would have to be round. The concept for a circular board first took form in the two player version. As refinements were made it became apparent that the two player board made for an excellent game of chess. With square chess it is difficult to invent a new line of play that is not already in a book. Whereas, VORTEX is a new frontier to be discovered. It is exciting to find the elegant symmetry and unit of the game. This is indeed chess! The tactics are exactly the same. The strategies are similar too. However where square chess simulates battle along frontal lines, VORTEX simulates a strategic global confrontation. As a result, VORTEX is an exciting dynamic and relevant chess game that puts a premium on a player's creativity.

The three player version is called VORTEX III. This game plays the same as VORTEX, but it is played on a larger board that provides for free-wheeling action. Here is a chess game that taxes the intellect while demanding shrewd judgment of character. This is a cut-throat game where the unpredicitability of people plays an important role! VORTEX III is the ultimate challenge.

The rules of VORTEX follow. Efforts have been made to make the instructions clear and complete. The player may be challenged by some aspects of the game at first, but once familiar with the board, players find themselves excited by the possibilities. One can create blistering attacks, brilliant defenses, and all of it is new!!

The Board

Figure 2:
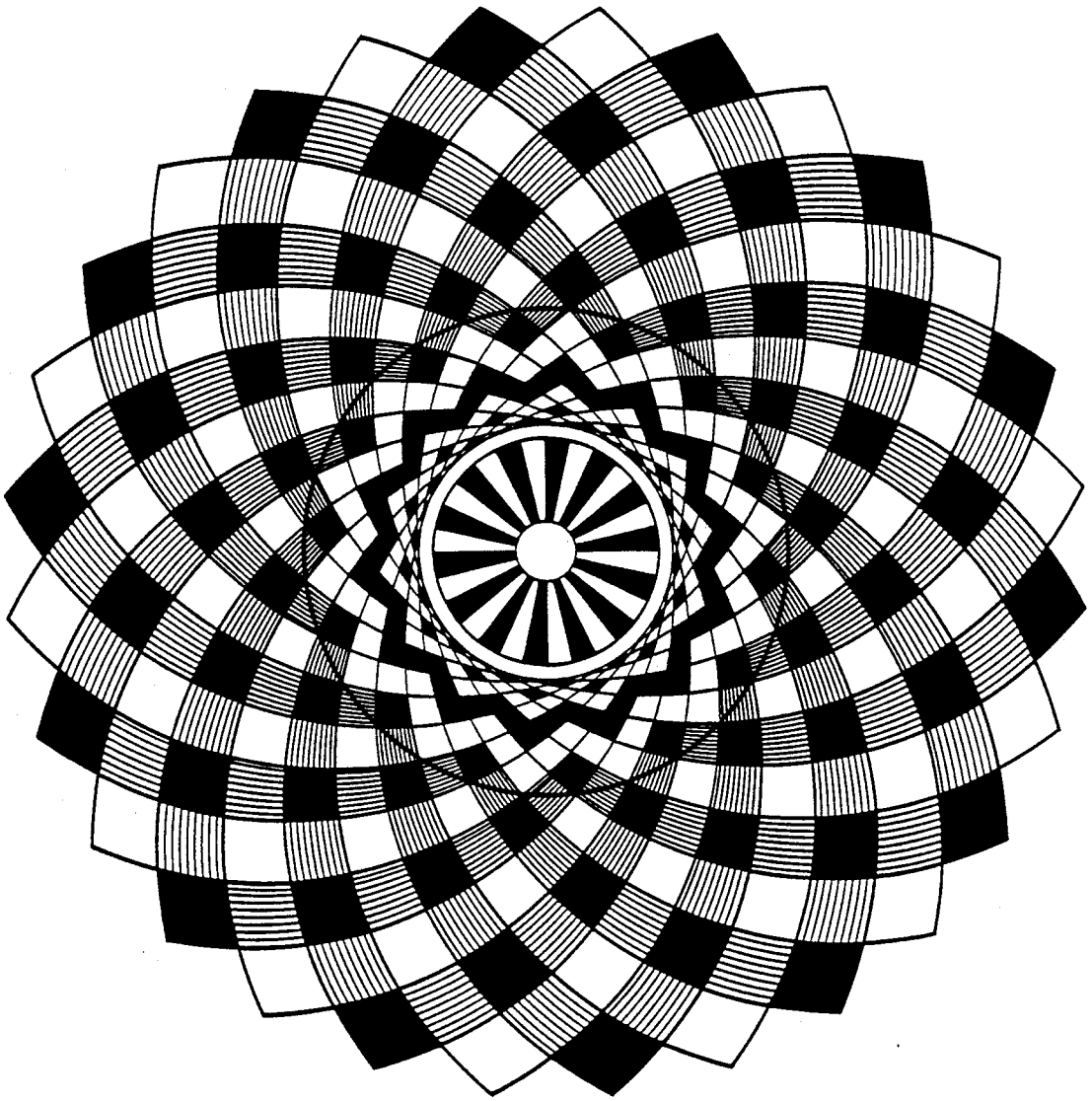
FIG. 2 is an illustration of the circular game board as shown in FIG. 1 in which a center graphic is included.

VORTEX is a chess game played on a circular board. The board is made up of four concentric rings each having twenty-eight playing spaces. Spaces alternate black and white around the rings and along the radii of the board. To help in visualizing the lines of play, neutral spaces are interspersed between the black and white playing spaces. See FIG. 1. The center of the board is such a neutral space and it is filled with a center graphic. The center graphic helps players to see the lines of play across the neutral center space (FIG. 2). A player's pieces never occupy any neutral space.

Movement of the Pieces

There is a direct analogy between the movement of the pieces in VORTEX and chess. The analogy between round chess and square chess is not a perfect one, but it is very helpful to know these similarities while learning to play the game:

1. Pieces that move along the files in square chess move along the diameters in round chess. There are eight playing spaces along each diameter of the round board as there are eight spaces along each file of the square board. Movement across the neutral center space takes place as though playing spaces on the inner ring were next to their neighbors across the center of the board.

2. Rings and Ranks

As the ranks on the square board allow left or right movement, the rings on the round board allow clockwise or counterclockwise movement. The main difference is that the round board has no boundary to this type of movement.

3. Arcs and Diagonals

Pieces moving on diameters or files, pieces moving on a diagonal stay on one color of space. On the round board pieces moving on one color of space travel in arcs. The longest diagonal on the square board is eight spaces. On the round board all of the arcs have eight spaces. Each arc crosses the center neutral space. The center graphic is useful in helping players visualize lines of play across the center. This is especially true for seeing the arcs on the board.

As stated above the analogy between round and square chess is not a perfect one. The playing spaces opposite from each other across the center are the same color. This creates some special conditions that will be presented in the discussion on the movement of the pawn.

INDIVIDUAL PIECES

The Rook

Figure 3:
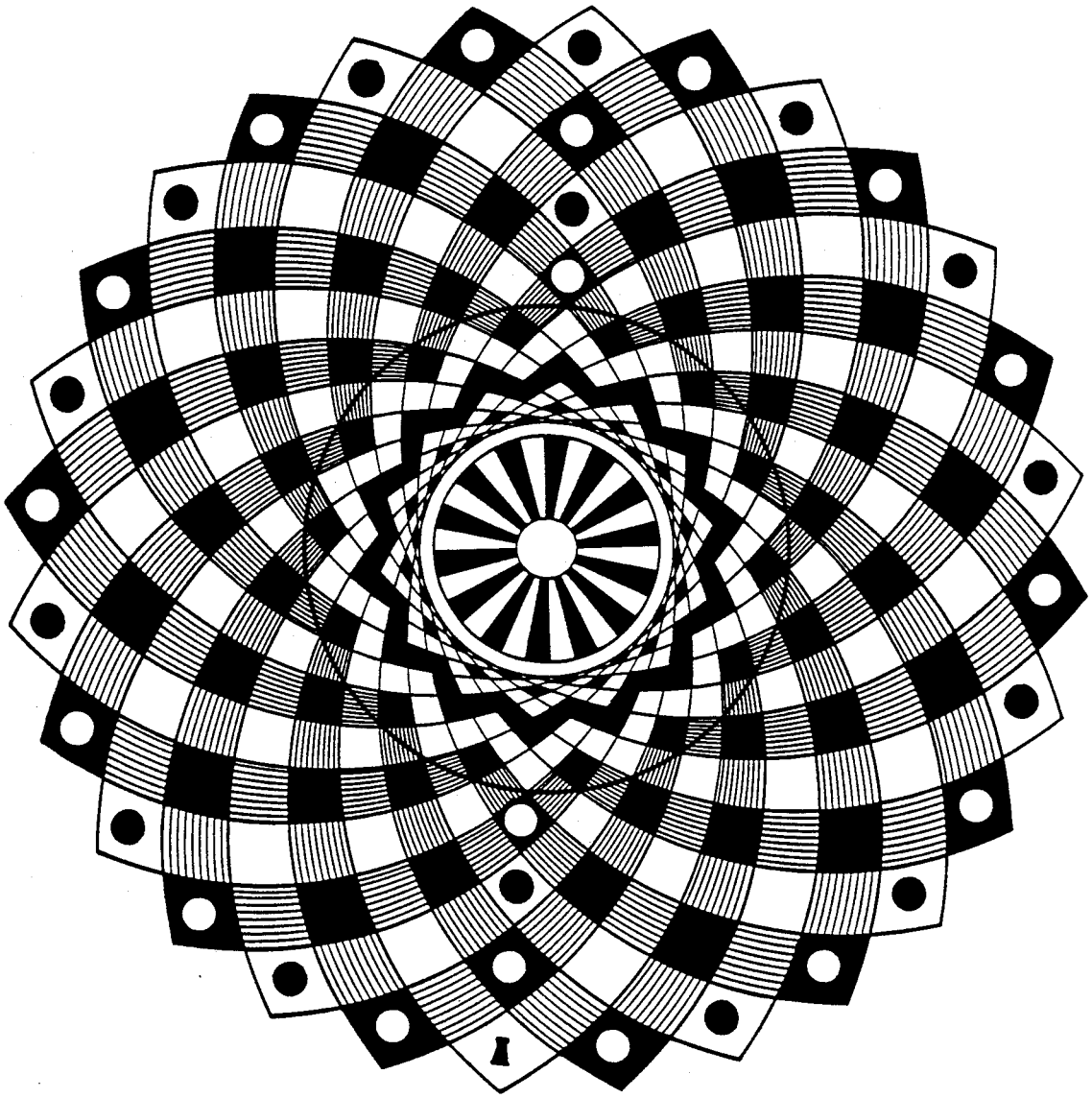
FIGS. 3 through 11 illustrate the manner in which various playing pieces may move and be captured.

The rook may be moved on either a ring or a diameter A rook may travel along either until it is blocked or commits capture. FIG. 3 uses black and white circles to mark the playing spaces that could be moved to by the unobstructed rook that is shown. A rook may cross the center freely on its diameter.

The space where a piece that is crossing the center re-enters the playing field is called the bridge position. A rook does not have to stop at the bridge position when crossing the center, but may continue as far as the outer ring of the board.

A rook may move on its ring in a clockwise or a counterclockwise clockwise direction as far as it's path is clear. Thus a rook may travel a ring all of the way around the board. The rook may not, however, return to its starting position since it would not have made a net move.

The Bishop

Each player has a bishop on each color of space. Bishops at no time change the color of the spaces they start on. Travel on one color on the round chess board creates movement along a circular arc. The arcs of the round board cross the central neutral space, but they do not intersect the center point of the board.

From any position on the board a bishop may travel along two arcs. During a move a bishop may travel on only one of its arcs. The bishop may cross the center freely and continue on until it is obstructed or commits capture.

Figure 4:
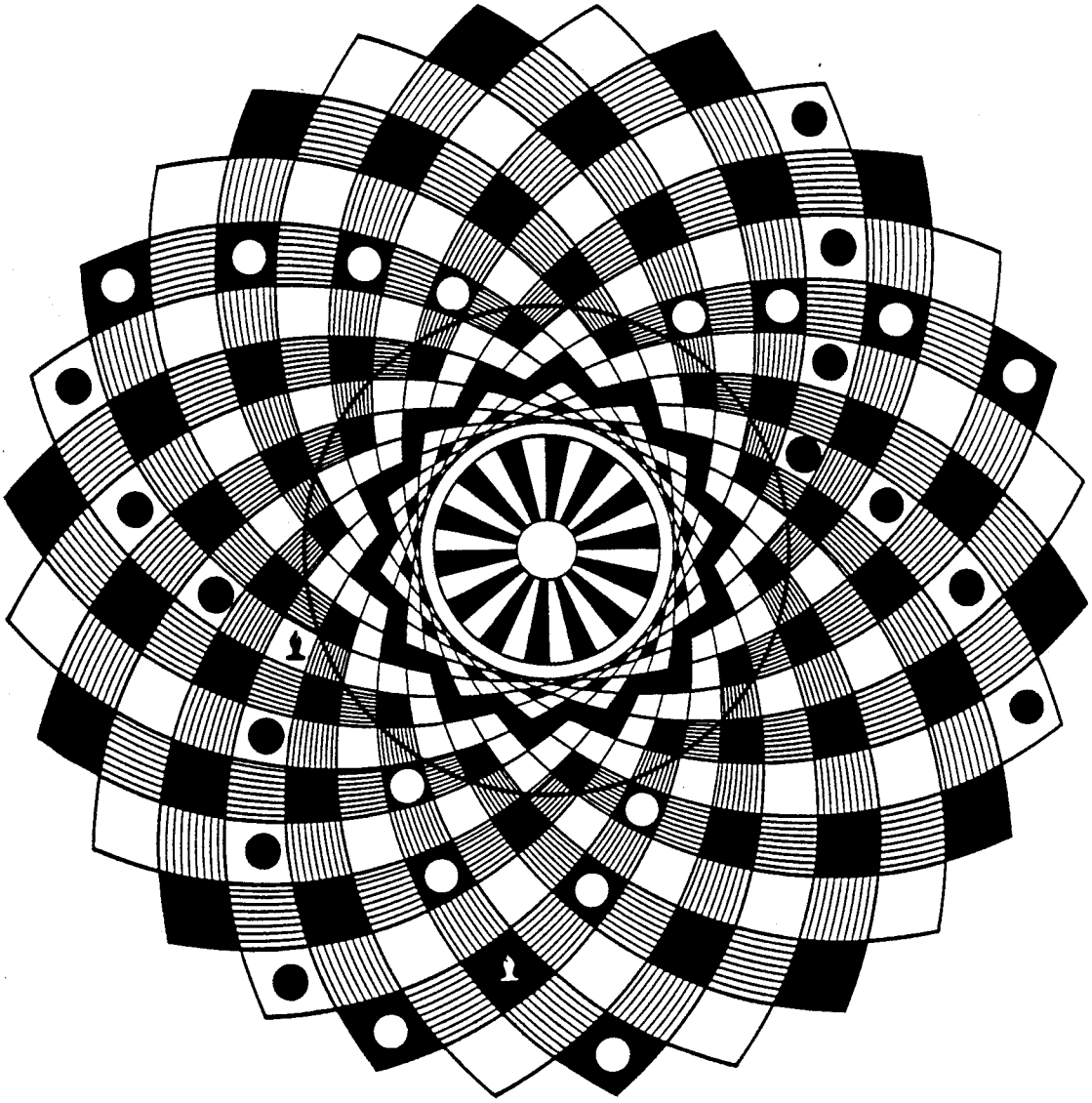

There are two possible situations for a bishop crossing the center neutral space FIG. 4 shows a black bishop on the inner ring and a white bishop not on the inner ring. For a bishop on the inner ring the two arcs it may travel intersect at two points, but it has only one bridge position. For a bishop not on the inner ring, its two arcs have only one point of intersection its starting position) and two bridge positions instead of one.

There are three ways to visualize or check movement of a piece crossing the center on an arc:

1. The arc a piece is traveling always leaves the center graphic to re-enter the playing area at the bridge position. Although the arcs do not cross the center point, the bridge positions of the arcs and diameters are the same. Thus, a bishop enters and exits the center neutral space along a diameter just like a rook.

2. Each arc has its end points on the outer ring. The playing spaces at the end of the arc are eight spaces apart. There are seven spaces between them.

3. Follow the arc through the graphic until its rainbow shape is seen. It takes some practice to pick up the knack of it, but once done it allows a player to see the lines of play much better.

The King

Figure 5:
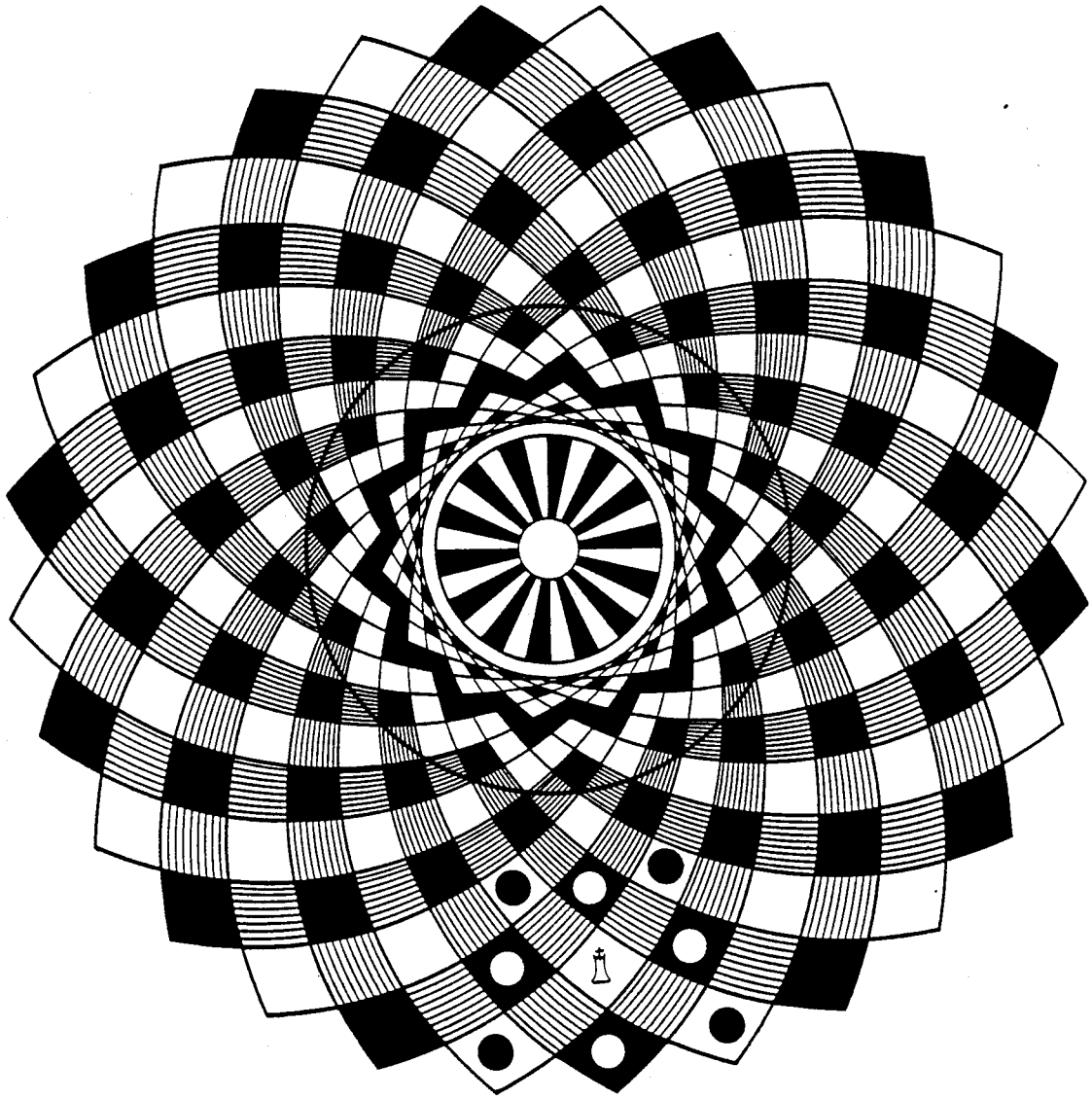
Figure 6:
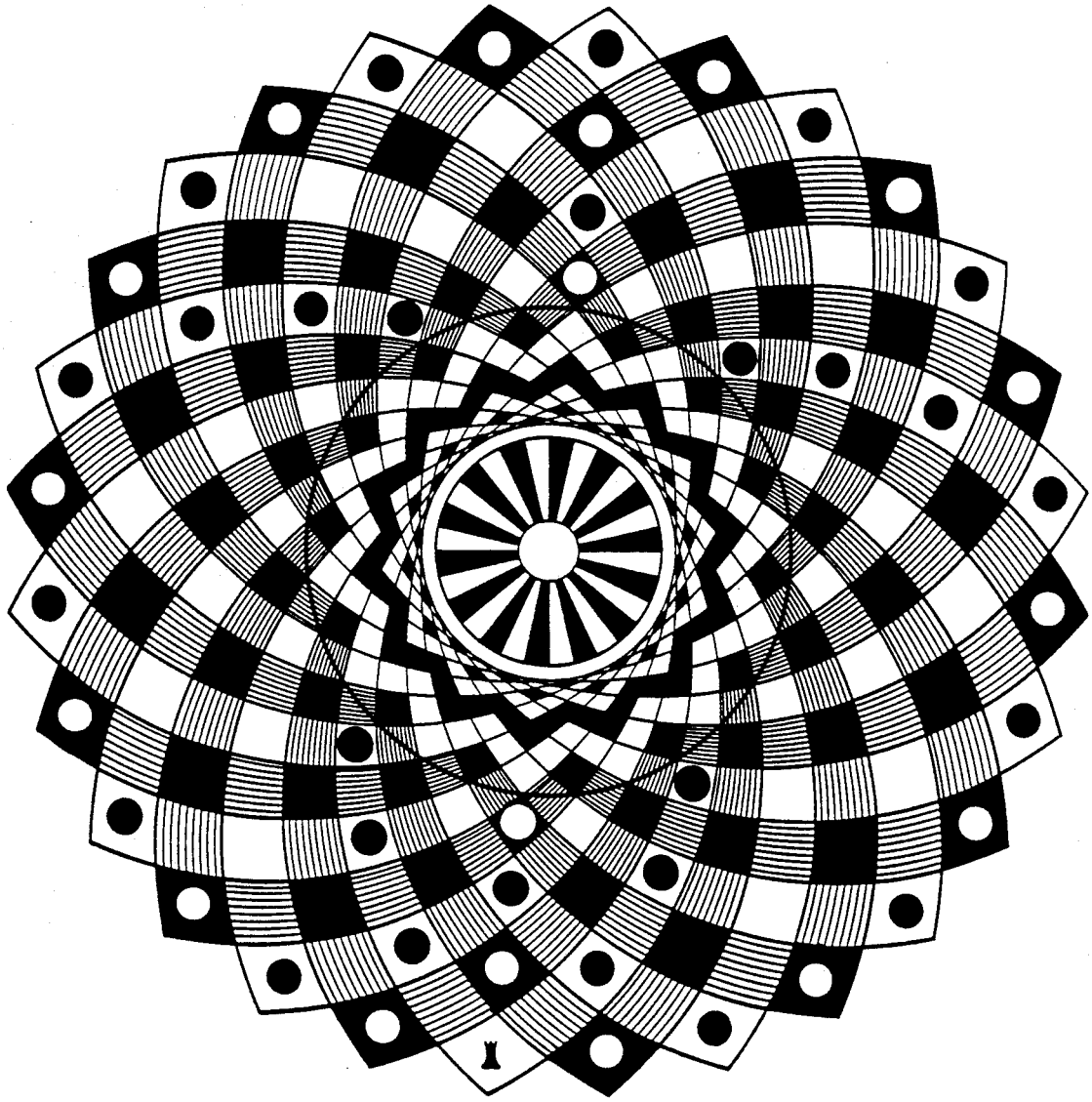

The king may move on the rings, diameters, or arcs. The king may move one space at a time in any direction. The king may cross the center from a position on the inner ring, but since the bridge positions for arc and diameter movement are the same on the inner ring, the king has only one bridge position. A king on the inner ring has only six spaces that it may move to. A king on the outer ring has only five options. Otherwise, the king has eight spaces that it may move to as shown in FIG. 5.

The king may be castled as in square chess to promote defense and development. Castling may be done on the king side or the queen side. Neither the king nor the rook may have been moved before castling. No pieces may be between the king and rook. The king is moved two spaces on the outer ring to the king or queen side, and the rook on that side is brought around to be next to the king on the space that the king passed over. The king may not be castled to get out of check, nor may it move through check or into check. None of the pawns play any role in castling.

The Queen

Figure 7:
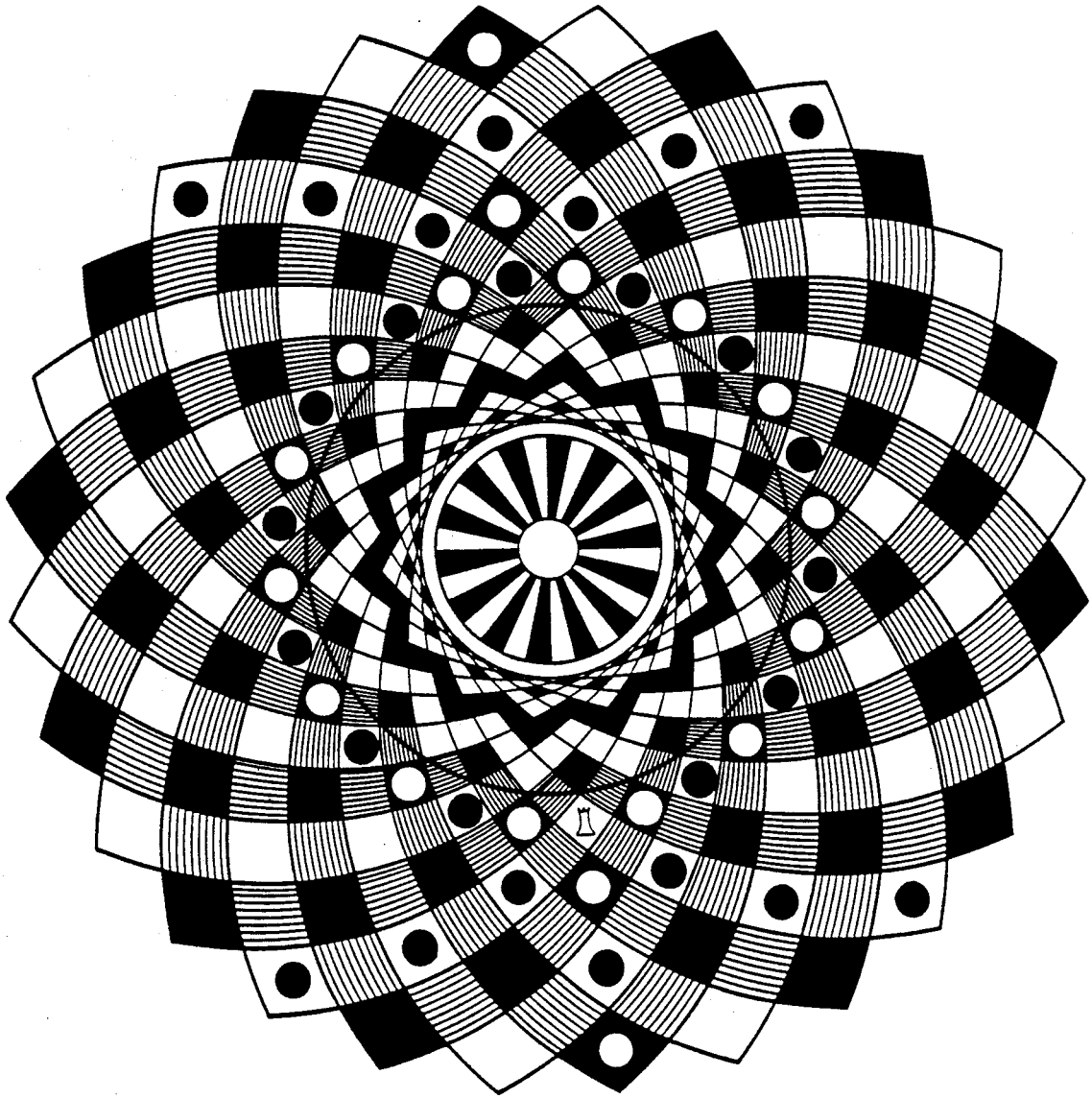

The queen, like the king, moves in any direction. The queen may move as a rook or a bishop until obstructed by a piece or the confines of the board. The queen may cross the center freely and may cross as a rook or a bishop. Thus, depending on its position, a queen may have up to three bridge positions. Such is the case shown in FIG. 6. Note that the unobstructed queen may move to forty-five different spaces. The situation changes for the queen on the inner ring (FIG. 7). Here the queen has only one bridge position. She still has forty-five options, but can only cross the center at one point. However, a queen on the inner ring controls all of the bridge points.

The Knight

The knight moves three spaces at a time. It may move two spaces on a ring and one on a diameter, or may move two spaces on a diameter and one space on a ring. The knight changes color when it moves except when crossing the center. When a knight crosses the center it will stand on the same color of space as it did when the move began. The knight is the only piece that is not obstructed playing pieces that lie between its starting and final positions.

Figure 8:
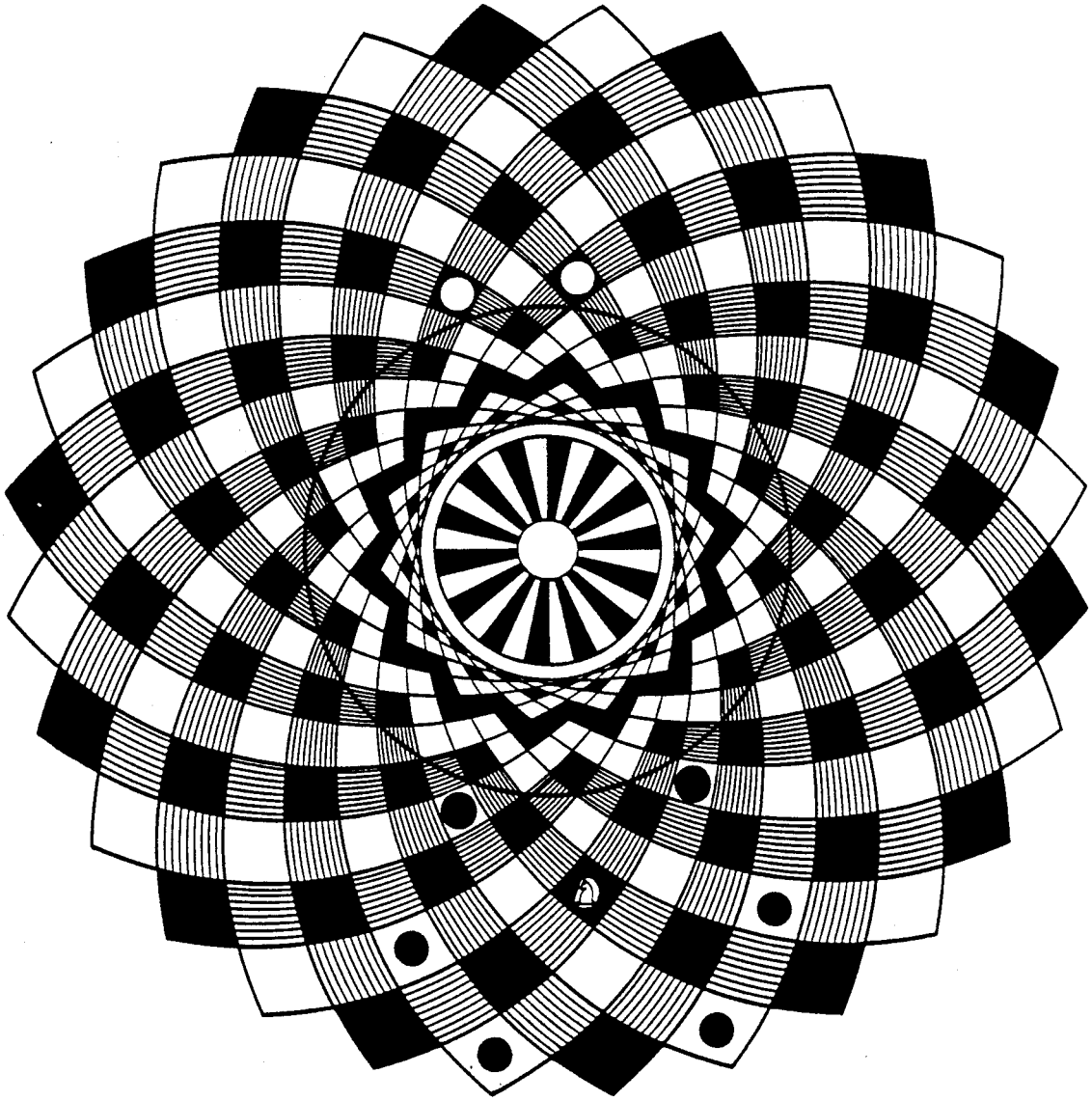

In FIG. 8 the knight is shown able to cross the center. The knight shown has two possible positions across the center. A knight on the inner ring has four possible positions across the center.

The Pawn

Pawns must always advance toward the outer ring across the center. Pawns advance along their diameter one space per move. Capture is made along an arc. Any piece directly ahead of a pawn blocks a pawn's advance. Pawns do not capture along a diameter.

On its first move a pawn may advance two spaces. If an opponent's pawn has crossed the center and stands on an adjacent diameter on the inner ring, the double move allows a pawn to pass by without offering the opportunity to capture. On the next move the opponent may capture the advanced pawn by moving behind it (as though it had only made a single move). This is the same condition as in square chess called en passent.

Figure 9:
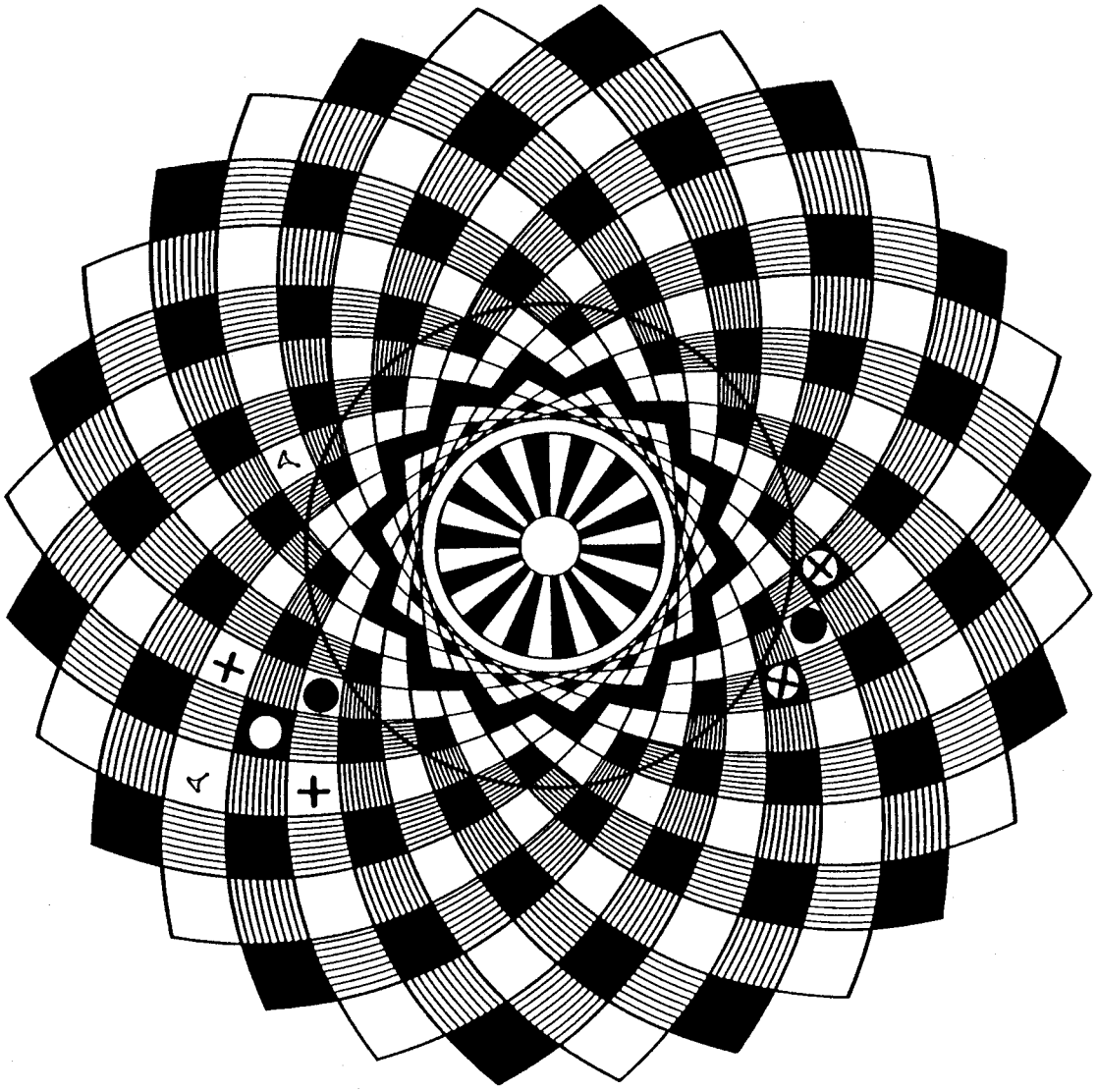

FIG. 9 shows the options for a pawn on its first move. The x markers indicate capture options. A pawn located on the inner ring is also shown. Note that it would appear to have three bridge points.

Pawns that advance to the outer ring may be promoted to any other playing piece desired except a king.

Pawn Rule

The pawn rule has to do with pawns capturing across the center of the board. Since the bridge points for the advance on the diameter and capture on the arcs are on the same space, pawns on the inner ring would be unable to perform their function. It would be possible for an opponent to achieve a passed pawn without offering capture. Therefore, the pawn rule provides that:

1. A pawn may only advance to its bridge position, and may not commit capture on that position. Any piece on that position along the diameter on the inner ring blocks the advance of the pawn.

2. Capture is permitted only on the spaces on either side of the bridge position when crossing the center. These spaces are not on any arc or diameter for the pawn.

Again refer to FIG. 9 showing a pawn on the inner ring. Note that the pawn advances to the same color of space and that it captures by changing color. This is exactly opposite of the case for a pawn located anywhere else on the board.

The Special Condition

Figure 10:
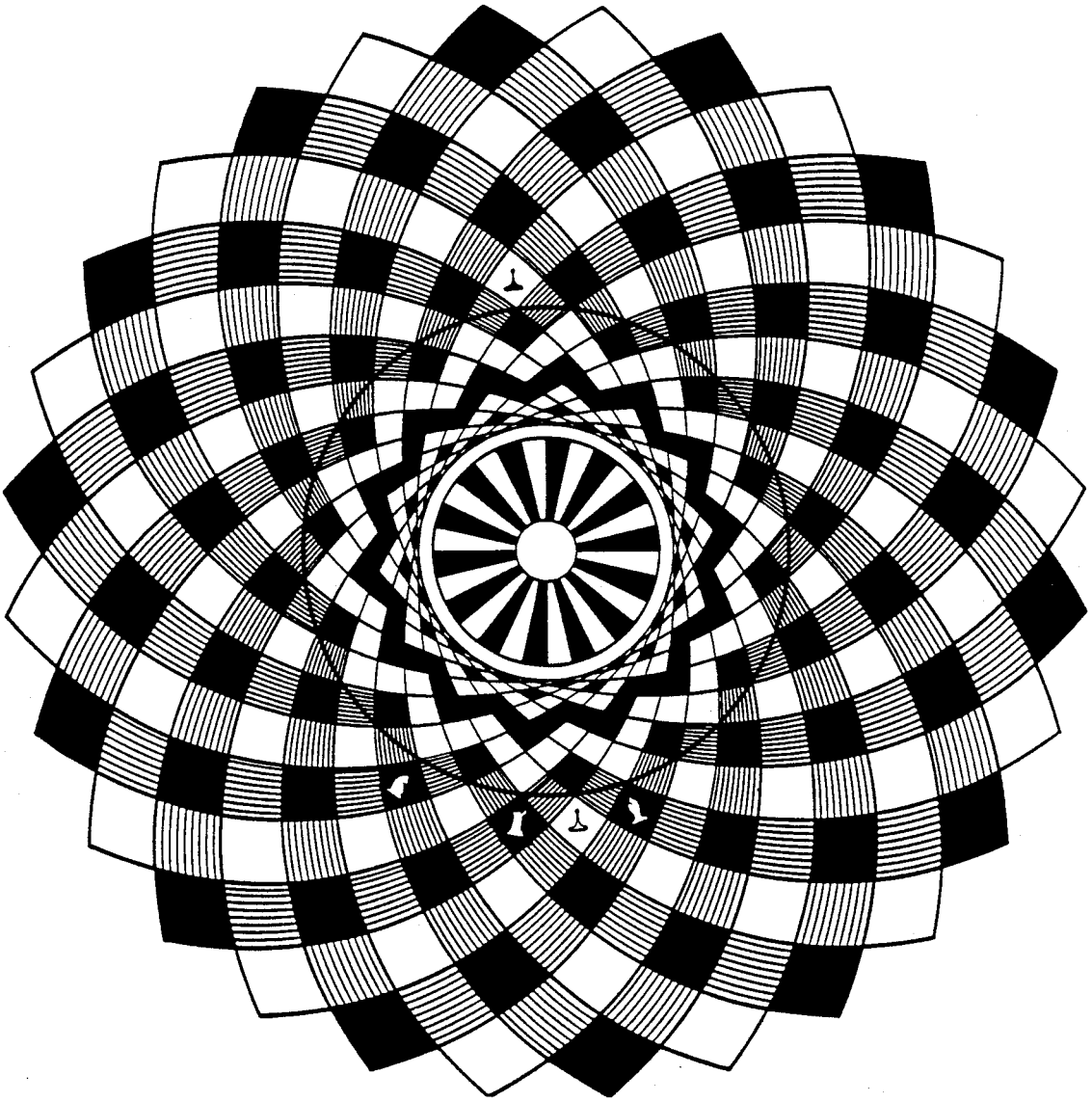

The pawn rule creates the possibility that an undefended pawn can attack pieces without offering capture. FIG. 10 shows a black pawn attacking white's queen and bishop. Black's pawn cannot be captured by any piece shown. The white pawn is straight ahead of the black pawn and they block each other's advance. White's queen and bishop have black spaces for bridge positions and, therefore, cannot capture black's pawn on the white space. If the knight shown was not there, the queen could capture the pawn by traveling the inner ring clockwise. The special condition can also affect the king. It is conceivable that a king on the inner ring could be checkmated by an undefended pawn. In practice the pawn rule works very well and plays into the game to maintain flow and continuity. The special condition is like a pitfall that one must learn to avoid, or like an opportunity that one may learn to exploit.

The Guard Pawn

Figure 11:
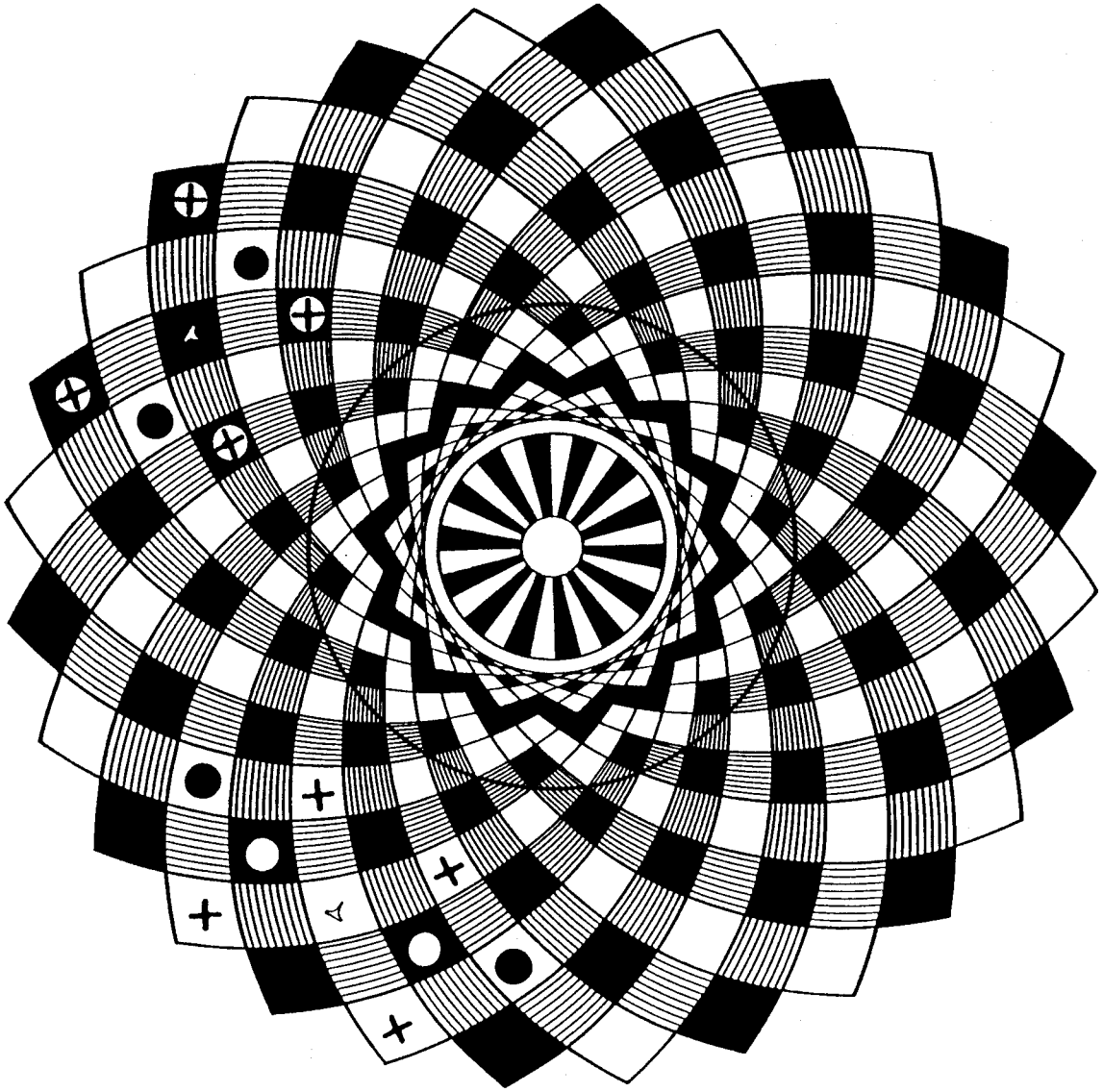

Without some form of protection along the flanks, the first move of every game would be rook captures rook. Flank defense is provided by guard pawns. They stand next to the rook and rook pawn on the king and queen sides of the setup. Guard pawns advance along the rings instead of the diameters. Capture is made along arcs and involves changing rings. Guard pawns may move clockwise or counterclockwise on any move, and they may capture in either direction. FIG. 11 shows the two basic situations for a guard pawn. On the right is a guard pawn with all of its options for the first move shown. Like the other pawns, a guard pawn may move two spaces on its first move. It may also capture on it's arcs. Note that even the double move may be made in either direction.

On the left in FIG. 11 the options for the guard pawn on all other moves are shown. If the opportunity arose, a guard pawn could move toward the center. It may cross the center or a capturing move. However, if a guard pawn crosses the center and gets to the outer ring, it cannot be promoted to a more powerful piece.

Since guard pawns are reversible, there is never the possibility of a passed pawn. Thererfore, guard pawns may never capture en passent.

The Setup

Figure 12:
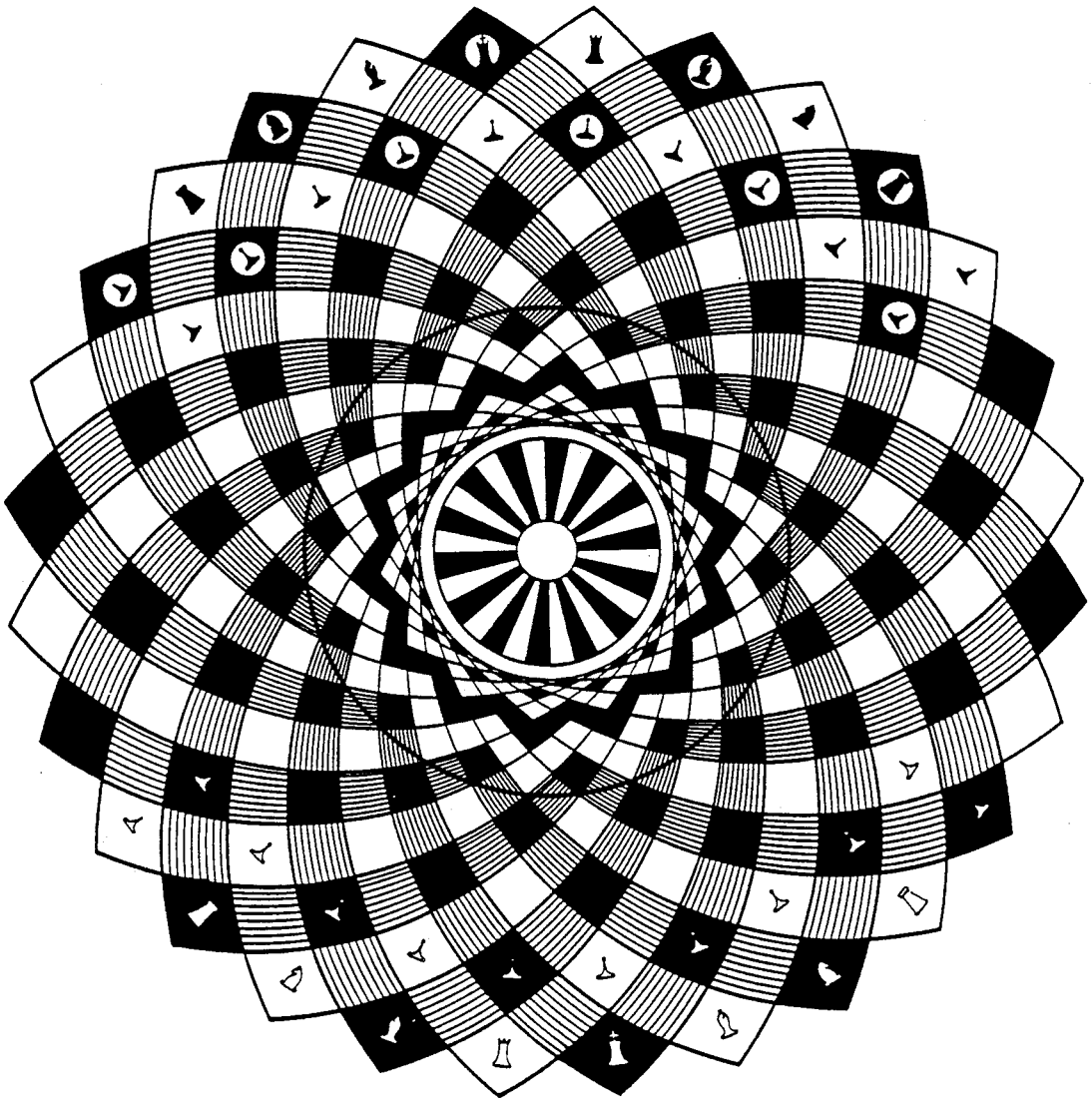
FIG. 12 illustrates the circular game board of this invention for two players with the starting positions for a chess type game being illustrated, the white pieces being indicated in white, and the black pieces being indicated in black.

VORTEX is played with twenty pieces per player. The beginning position of all the pieces is shown in FIG. 12. The king begins on a black space with the queen to the left on white. White's king is opposite black's king on the same diameter. The white and black queens are also opposed on the same diameter. Note that both players being with the king on black and the queen on white.

Notation

Each playing space is identifiable by diameter and ring. The rings are noted by numbers; the diameters are named for the piece that stands on that diameter in the setup. In discussion about moves and position it is also helpful to name the rings. The outermost ring is the "A" ring. The innermost ring on the playing field is the "D" ring. Thus, the notation P-K4 moves the pawn on the king diameter to the fourth position which is the "D" ring. The move P-K5 advances the pawn to the fifth position on the king diameter which is a move across the center The pawn at king five is, however, still on the "D" ring.

There are more diameters than pieces. Each player has four diameters on their side of the board that have no pieces on them at the setup. The spaces beyond the guard pawns are referred to as the "Y" and "Z" positions. Thus a guard pawn may move from KG1 to KY1, or if the double move is used the guard pawn would advance to KZ1. If the same guard pawn was advanced again it would be written G-QZ 8 which is read, guard pawn to the eighth position of the QZ diameter, or simply guard pawn to queen's zee eight. Note that the guard pawn has now advanced onto the queen side of the board for both black and white.

Figure 13:
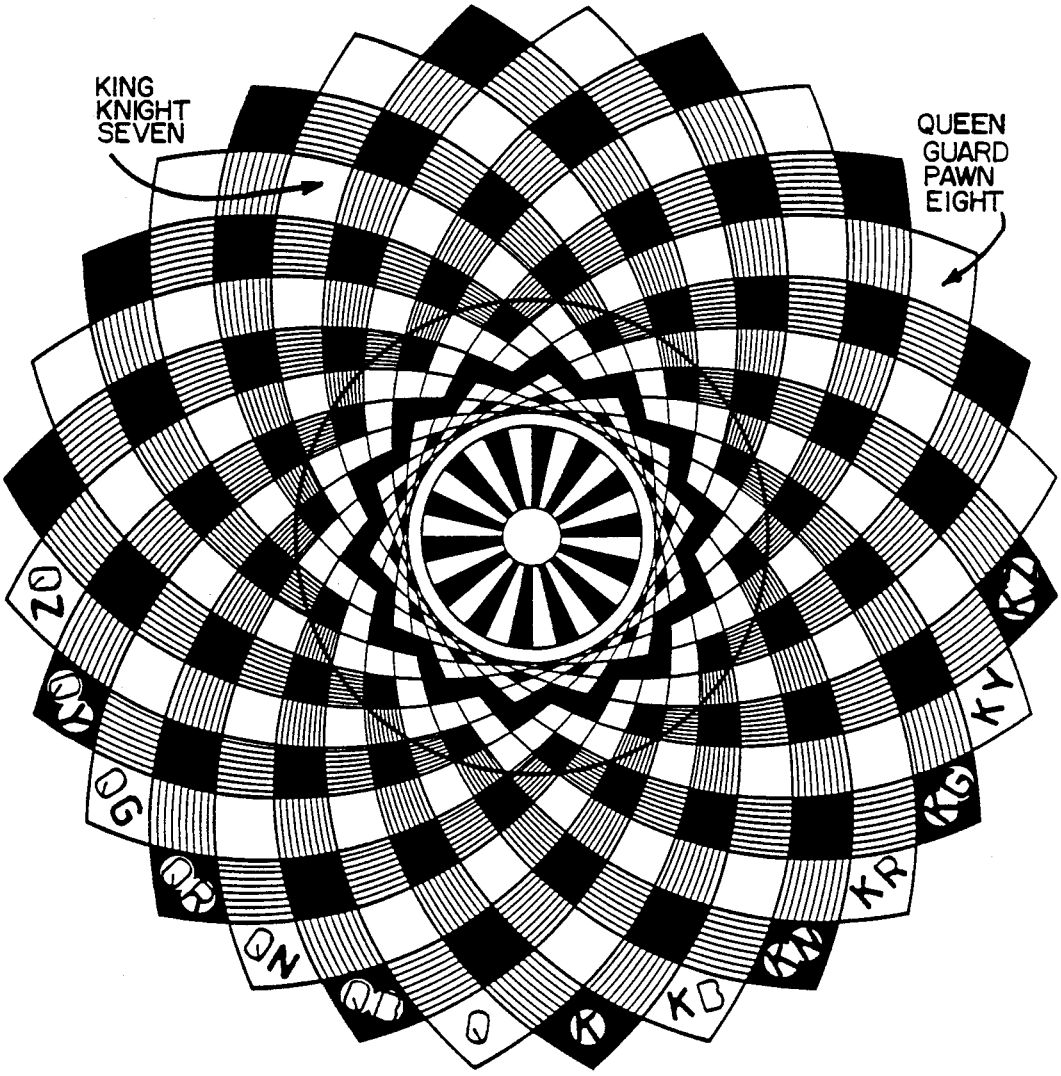
FIG. 13 illustrates the circular game board of this invention with round chess notation applied thereto.

All of a player's moves are recorded from their own perspective. Thus black's king begins the game at white's king 8. FIG. 13 illustrates VORTEX notation.

Check and Checkmate

Any piece in a position to capture an opponent's king is said to put the king in check. A player must move to relieve the king from the check condition. There are three ways to get the king out of check:

1. Move the king to a position out of check.
2. Move a piece between the king and the attacker.
3. Capture the attacking piece.

Figure 14:
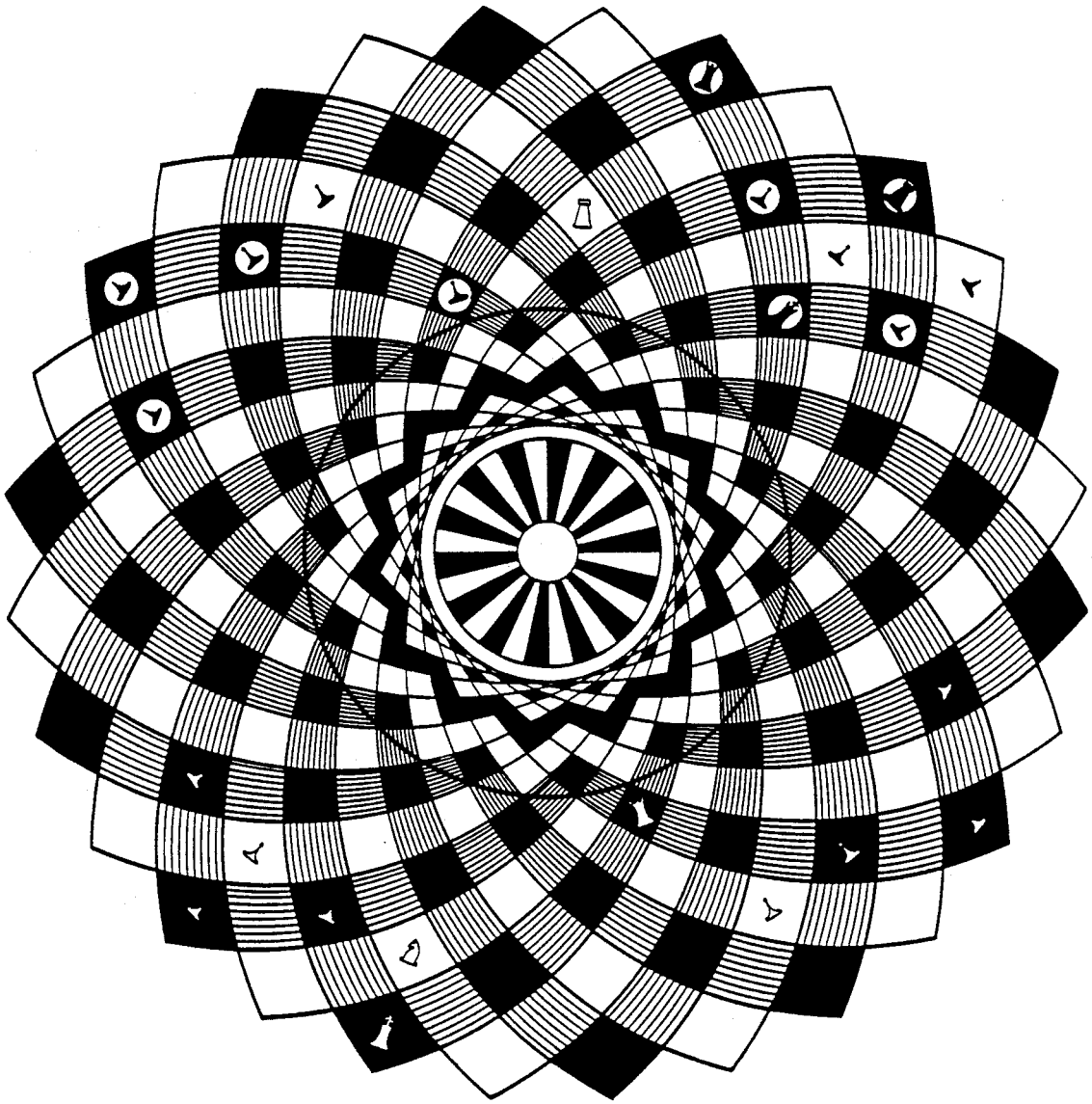
FIGs 14, 15 and 16 illustrate check and checkmate.

If none of these three are options and the king may not get out of the check condition, the situation is called checkmate and the game is concluded. Following are three checkmate situations for the VORTEX game:

1. FIG. 14 shows the black king in check with the white rook. This is an end game situation and most of the pieces are gone. It would seem that this apparent checkmate might be avoided with a simple pawn move (P-QN3). However the pawn would only block the rook from its clockwise attack. The king is still in check as the rook travels counterclockwise.

Figure 15:
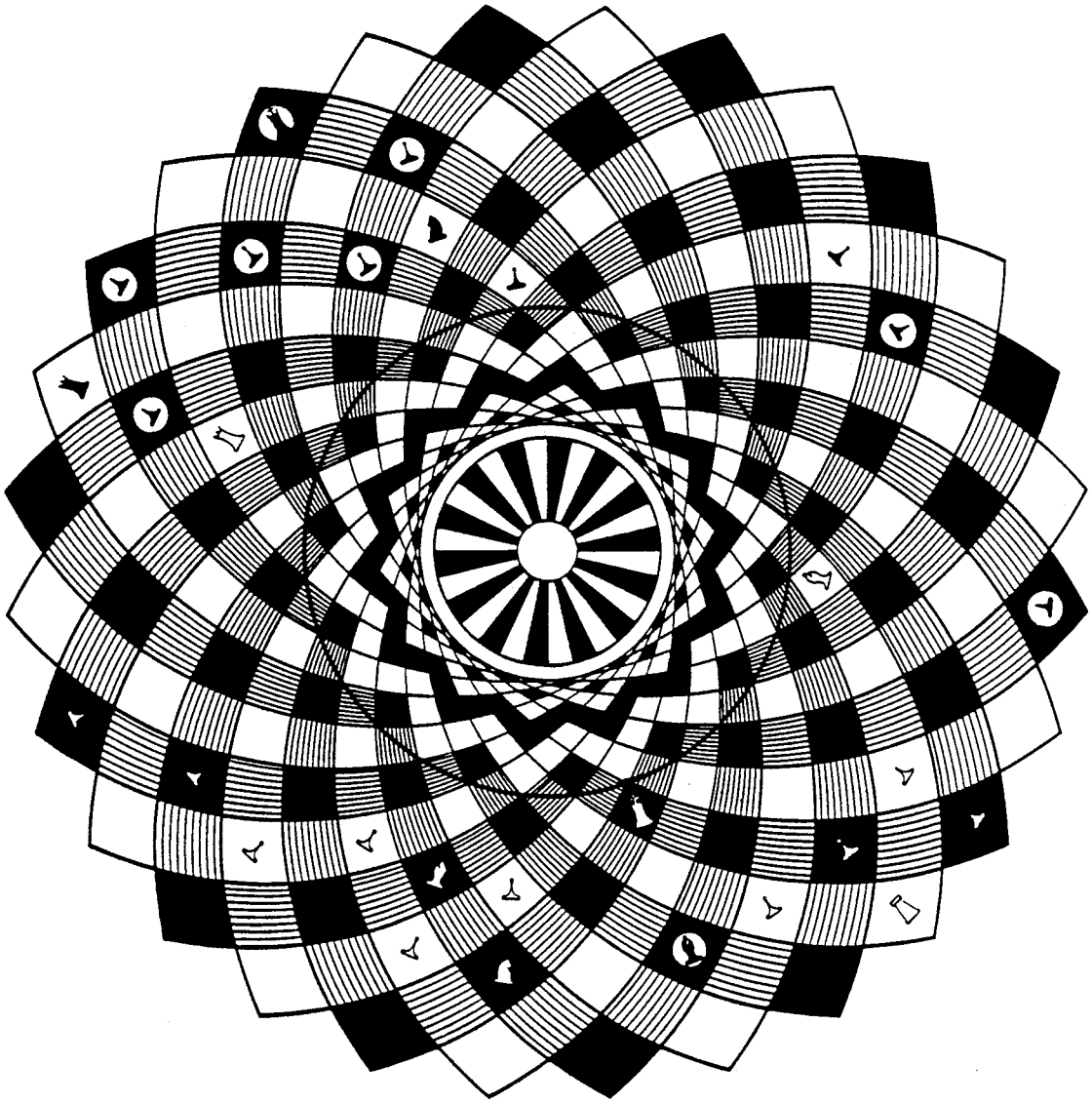

2. FIG. 15 shows the king in checkmate by pawn rule under the special condition (since the pawn is undefended).

3. Finally, a very short game whose end is shown in FIG. 16.

| WHITE | BLACK |
|---|---|
| 1. P-QN4 | P-K4 |
| 2. P-K3 | P-Q4 |
| 3. B-KZ1 | N-QB3 |
| 4. Q-B3 | P-K5 |
| 5. Q X KBP | CHECKMATE! |

Introducing VORTEX III

Here is a chess game for three players. The basic design of the VORTEX board has been expanded to accommodate three players. The pieces are moved in the same way as the two player game, but all new strategies are needed to play a three player game. This is a cut-throat situation where an opponent may be an ally on one move and an attacker on the next move. More than logic and creativity are needed to succeed at VORTEX III. One must also be a good judge of character!

The Board

The three player board is composed of five rings of forty-two playing spaces each. Like the two player board there are neutral spaces between the black and white playing spaces, and a center graphic to assist in seeing the lines of play. These neutral spaces are not part of the playing field. FIG. 17 shows the VORTEX III board without a center graphic, while FIG. 18 shows the board with a center graphic.

Piece Movement

Each of the three players have a set of playing pieces identical to the VORTEX setup. The kings are all on the outer ring on black playing spaces fourteen spaces apart. This leaves four spaces between the guard pawns of any two players.

All of the pieces move in the same manner as the two player game. The structure of the center is such that diameter bridge points have opposite color. Therefore, no pawn rule or special conditions exist in VORTEX III This also means that for pieces like the queen, the diameter bridge points are never the same as the arc bridge points.

Playing the Round Three Game

White makes the first move. Red, the opponent clockwise on the board from white makes the next move. Finally black moves and play returns to white.

Each player's center pawns have a clear path to the outer ring and promotion. Players must "do their duty" and stop such advances even at the expense of their own development. To fail to do this or to help build mutual defenses leads to being overrun.

Two players may team up to checkmate a third player. If the white player checks the red player, red may not move into the path of any black pieces to escape. Another situation may arise in the case of a player checking the opponent who proceeds them. for example, it is red's turn and red puts a check on the white king. Now it is black's move. Black now has many options:

1. Black may put a second check on white creating double check.
2. Black may block or capture red to relieve white from check.
3. Black may assist in checkmating white.
4. Black may capture a white piece knowing that white must respond to red's check.
5. Black may pursue it's own objectives and even place a check on red.

When a player is checkmated, all of that player's pieces are removed from the board and the remaining players continue until an end is reached. It should be noted that the removal of one player's pieces may jeopardize another player. It is possible that the two remaining players may put each other in checkmate as the result of removing the third player's pieces. In that case, the player whose turn would be next is the loser.

© Copyright 1989, Curtis Hoerbelt

While two different forms of the circular game board of this invention have been disclosed, it should be noted that other forms of game board may be employed. For example, the circular game board may be developed for four or more players. In addition, somewhat differing forms of center graphics may be employed. Therefore, while preferred game boards in which the principles of the present invention have been incorporated are shown and described above, it is to be understood that this invention is not to be limited to the particular details shown and described above, but that, in fact, widely differing means may be employed in the practice of the broader aspects of this invention.

What is claimed is:

1. A circular game board for play of a game of a variety of chess by two or more players, the board comprising:

a plurality of playing spaces arranged in circular ranks and radial files, said circular game board being bounded by an outermost periphery comprising an outer circular rank and an innermost periphery comprising an inner circular rank, the playing spaces each being distinguishable into two sets, a first set of playing spaces being distinguished by a first color and a second set of playing spaces being distinguished by a second color;

a plurality of diagonal paths, each diagonal path extending in an arcuate fashion from the outermost periphery to the innermost periphery, each diagonal path having a common set of playing spaces;

a plurality of non-playing spaces distinguishable from said playing spaces by a third color, a non-playing space being alternatingly disposed between each of the playing spaces in each of the diagonal paths; and a neutral central area bounded by the innermost periphery.

2. The board as set forth in claim 1 wherein each player initially has 20 playing pieces, 16 of the pieces corresponding to standard chess pieces, each of the pieces having the same movement as a corresponding piece in standard chess, and the four additional pieces being guard pawns with movements the same as chess pawns but at right angles thereto.

3. The board as set forth in claim 2 wherein each player's pieces are initially set up in essentially the same manner as in a standard chess game but with the king always to the same side of the queen, and wherein the four guard pawns are set up with two of the guard pawns being in that file immediately adjacent the king's rook and the other two guard pawns being set up in that file immediately adjacent the queen's rook, with two of the guard pawns being in the same rank as the noble pieces and the other two being in the same rank as the pawns.

4. The board game as set forth in claim 1 wherein there is a center graphic which helps a player visualize movement across the neutral central area.

5. A circular game board for play of a game of a variety of chess by two or more players, the board comprising:

a playing area resembling a ring about a neutral central area, the ring being divided into a number of spaces by a plurality of intersecting arcs of circles, which arcs have centers evenly spaced apart on a single circle, said arcs defining a plurality of spaces, which spaces are distinguishable into first and second sets of adjacent spaces in radial files meeting only at their vertices, the first sets of spaces being playing spaces and the second sets being non-playing spaces, the playing spaces being distinguishable into two colors, and the non-playing spaces into a third color, the playing spaces also being arranged in circular rings, there being an innermost peripheral rank of playing spaces and an outermost rank of playing spaces, said playing spaces defining a plurality of arcuate paths comprised of one color of playing spaces and non-playing spaces in alteration.

* * * * *